US011044541B1

(12) United States Patent
Ambrose et al.

(10) Patent No.: US 11,044,541 B1
(45) Date of Patent: Jun. 22, 2021

(54) LOUDSPEAKER WITH MOUNTING ASSEMBLY

(71) Applicant: Stillwater Designs and Audio, Inc., Stillwater, OK (US)

(72) Inventors: Kyle A. Ambrose, Stillwater, OK (US); Chanc L. Bergbower, Stillwater, OK (US); James E. Sharp, Stillwater, OK (US)

(73) Assignee: Stillwater Designs and Audio, Inc., Stillwater, OK (US)

( * ) Notice: Subject to any disclaimer, the term of this patent is extended or adjusted under 35 U.S.C. 154(b) by 45 days.

(21) Appl. No.: 16/551,427

(22) Filed: Aug. 26, 2019

Related U.S. Application Data

(66) Substitute for application No. 62/725,181, filed on Aug. 30, 2018.

(51) Int. Cl.
*H04R 1/02* (2006.01)
*H04R 1/32* (2006.01)

(52) U.S. Cl.
CPC ..... *H04R 1/026* (2013.01); *H04R 1/323* (2013.01); *H04R 2201/025* (2013.01)

(58) Field of Classification Search
CPC ..... H04R 1/02; H04R 1/025; H04R 1/026
USPC ..... 381/386–395
See application file for complete search history.

(56) References Cited

U.S. PATENT DOCUMENTS 3,023,990 A 3/1962 Gunthel, Jr.
4,338,875 A 7/1982 Lisowski
4,697,775 A 10/1987 Wille
D305,333 S 1/1990 Irby
D307,015 S 4/1990 Irby
5,009,384 A 4/1991 Gerke et al.
(Continued)

FOREIGN PATENT DOCUMENTS

AU 773216 B2 9/2004
AU 2004205159 8/2006
(Continued)

OTHER PUBLICATIONS

Owers & Wilkins, "Architectural Monitoring AM-1," Quick Start Guide, 2002, 12 pages, B&W Group Ltd., Worthing West Sussex, England, UK.
(Continued)

*Primary Examiner* — Suhan Ni
(74) *Attorney, Agent, or Firm* — Mary M. Lee

(57) ABSTRACT

A loudspeaker with a mounting assembly is ideally suited for attachment to a wakeboard tower. The mounting assembly includes a clamp assembly for attaching to the tower and a swivel assembly attached to the speaker enclosure. The base of the clamp assembly defines a docking channel that extends generally, and an electrical terminal is positioned at the blind end of the docking channel. The swivel assembly includes a bracket for attaching to the speaker housing and a terminal block that is rotatably mounted on top of the bracket. In this way, once the clamp assembly is attached to the tower bar, the terminal block can be guided into the docking channel by holding the speaker housing. The need to manage wires while mounting the speaker is eliminated by the pin and socket electrical terminals, and the swivel-mounted terminal block aligns itself as it is inserted into the docking channel.

12 Claims, 18 Drawing Sheets

(56) References Cited

U.S. PATENT DOCUMENTS

| | | | | |
|---|---|---|---|---|
| D355,193 | S | 2/1995 | Irby | |
| 5,859,917 | A * | 1/1999 | Silber | H04R 9/02 381/386 |
| 5,941,653 | A | 8/1999 | Cipriani | |
| D449,293 | S | 10/2001 | Irby et al. | |
| D456,386 | S | 4/2002 | Irby et al. | |
| 6,374,942 | B1 | 4/2002 | Huggins | |
| D473,216 | S | 4/2003 | Irby et al. | |
| 6,611,604 | B1 | 8/2003 | Irby et al. | |
| 6,719,255 | B2 | 4/2004 | Chen | |
| 6,731,773 | B1 | 5/2004 | Bergbower et al. | |
| 6,798,892 | B2 | 9/2004 | Parnell | |
| 6,968,069 | B1 | 11/2005 | Zhao | |
| 7,150,578 | B2 | 12/2006 | Porco | |
| 7,309,054 | B2 | 12/2007 | Slatter et al. | |
| 7,350,755 | B1 | 4/2008 | Harrison | |
| 7,665,699 | B2 | 2/2010 | Oddsen, Jr. et al. | |
| 7,712,714 | B2 | 5/2010 | Jackson et al. | |
| 7,916,890 | B2 | 3/2011 | Irby et al. | |
| 3,023,688 | A1 | 9/2011 | Irby et al. | |
| 8,014,554 | B2 * | 9/2011 | Xu | H04R 1/345 381/386 |
| 8,126,184 | B2 | 2/2012 | Parker | |
| 8,141,839 | B2 | 3/2012 | Buchner | |
| 8,371,730 | B2 | 2/2013 | Mitchell | |
| 8,568,162 | B1 | 10/2013 | White et al. | |
| 9,050,936 | B2 | 6/2015 | Jordan | |
| 9,194,407 | B1 | 11/2015 | Straney et al. | |
| 9,381,869 | B2 | 7/2016 | Jordan et al. | |
| 9,381,870 | B2 | 7/2016 | Jordan et al. | |
| 9,393,898 | B2 | 7/2016 | Hasbrook et al. | |
| D783,577 | S | 4/2017 | Ambrose et al. | |
| 9,610,888 | B2 | 4/2017 | Eboli | |
| D798,837 | S | 10/2017 | Surratt et al. | |
| D807,326 | S | 1/2018 | Justis | |
| D820,815 | S | 6/2018 | Justis | |
| D852,781 | S | 7/2019 | Hotson et al. | |
| 2003/0194104 | A1 | 10/2003 | Irby et al. | |
| 2003/0228028 | A1 * | 12/2003 | Parnell | H04R 1/025 381/386 |
| 2007/0295874 | A1 | 12/2007 | Hollenhead et al. | |
| 2008/0049958 | A1 | 2/2008 | Bingaman | |
| 2008/0075318 | A1 | 3/2008 | Zhao | |
| 2008/0118098 | A1 | 5/2008 | Irby et al. | |
| 2014/0199884 | A1 | 7/2014 | Jordan | |
| 2016/0152172 | A1 | 6/2016 | Eboli | |

FOREIGN PATENT DOCUMENTS

| | | |
|---|---|---|
| CA | 2387939 | 9/2006 |
| CN | 101257733 | 8/2012 |
| EP | 1222839 | 7/2012 |
| ID | 018046 | 9/2006 |
| KR | 554818 | 2/2006 |
| MX | 227315 | 4/2005 |
| MY | 125083 | 7/2006 |
| SG | 87643 | 5/2005 |
| TH | 048559 | 3/2016 |
| TW | 498700 | 12/2002 |
| WO | 0131975 A2 | 5/2001 |

OTHER PUBLICATIONS

Stillwater Designs and Audio, Inc., "Kicker Marine Long-Range Tower System," owners manual, 2007, 4 pages, Stillwater Designs and Audio, Inc., Stillwater, Oklahoma, USA.

Stillwater Designs and Audio, Inc., "Kicker KM Tower Enclosures," owner's manual, 2015, 16 pages, Stillwater Designs and Audio, Inc., Stillwater, Oklahoma, USA.

Stillwater Designs and Audio, Inc., "Kicker KMTC Loaded Marine Cans," owner's manual, 2017, 20 pages, Stillwater Designs and Audio, Inc., Stillwater, Oklahoma, USA.

Stillwater Designs and Audio, Inc., "Kicker KMT67 Long-Range Tower System," owner's manual, 2013, 16 pages, Stillwater Designs and Audio, Inc., Stillwater, Oklahoma, USA.

* cited by examiner

LOUDSPEAKER WITH MOUNTING ASSEMBLY

CROSS-REFERENCE TO RELATED APPLICATIONS

This application claims the benefit of U.S. provisional application No. 62/725,181, entitled "Loudspeaker with Mounting Assembly," filed Aug. 30, 2018, the contents of which are incorporated herein by reference.

FIELD OF THE INVENTION

The present invention relates generally to loudspeakers and more particularly but without limitation to loudspeakers with attached mounting assemblies.

BRIEF DESCRIPTION OF THE DRAWINGS

The accompanying drawings, which are incorporated into and form a part of the specification, illustrate one or more embodiments of the present invention and, together with this description, serve to explain the principles of the invention. The drawings merely illustrate preferred embodiments of the invention and are not to be construed as limiting the scope of the invention.

DETAILED DESCRIPTION OF THE PREFERRED EMBODIMENT(S)

Those who enjoy water sports like to attach loudspeakers to structures on the boat so that they can enjoy music while they recreate on the water. So-called "wakeboard tower speakers" are sold for this application. The speaker enclosure typically is a small cone or bullet-shaped housing with a bracket on top that attaches the speaker to the wakeboard tower or other horizontal bar-like structure or elongate support. The electrical wiring from the speaker is threaded through the bracket and into the wakeboard bar.

In one embodiment, the present invention is an improved mount for these tower speakers. The inventive mount offers several advantages residing in the way the speaker enclosure is attached to the clamp. The mount comprises the clamp that attaches to the wakeboard tower bar and a swivel assembly that is attached to the top of the speaker enclosure.

The clamp is attached to the wakeboard tower bar first, and then the speaker enclosure is slid into place. This is made possible by using a pin and socket terminal to make the electrical connections between the swivel assembly on the top of the speaker and base of the clamp. The installer does not have to manage the wiring and connecting bolts while at the same time attaching the enclosure to the clamp.

The swivel assembly provides a self-aligning feature that is advantageous during installation. The movable fitting will self-rotate as it is guided into the clamp base so that it is aligned for proper engagement of the pin and socket terminal. The swivel also permits the position of the mounted speaker to be adjusted to direct the sound as desired.

Turning now to the drawings in general and to FIGS. 1-4 in particular, there is shown therein a loudspeaker assembly 10 comprising a loudspeaker 12 and a mounting assembly 14. "Loudspeaker" and "speaker" are used synonymously herein and refer to a device that converts electric signals to audible sound and may be used interchangeably with the term "speaker." In addition to including audio signal transmission wires, a loudspeaker may include light signal transmission wires connected to one or more light components incorporated into the loudspeaker. The integrated light components may be any type of light source, such as but not limited to light emitting diodes. "Loudspeaker" includes devices dedicated to selected ranges, such as mid-range, tweeter, and subwoofer. "Loudspeaker" is not limited to any particular design or mechanism of operation. For example, the cone-shaped or bullet shaped speaker shown and described herein may include a horn-loaded compression driver and have a frequency response range of about 20 to about 20,000 Hz, but the invention is not so limited.

Figure 2:
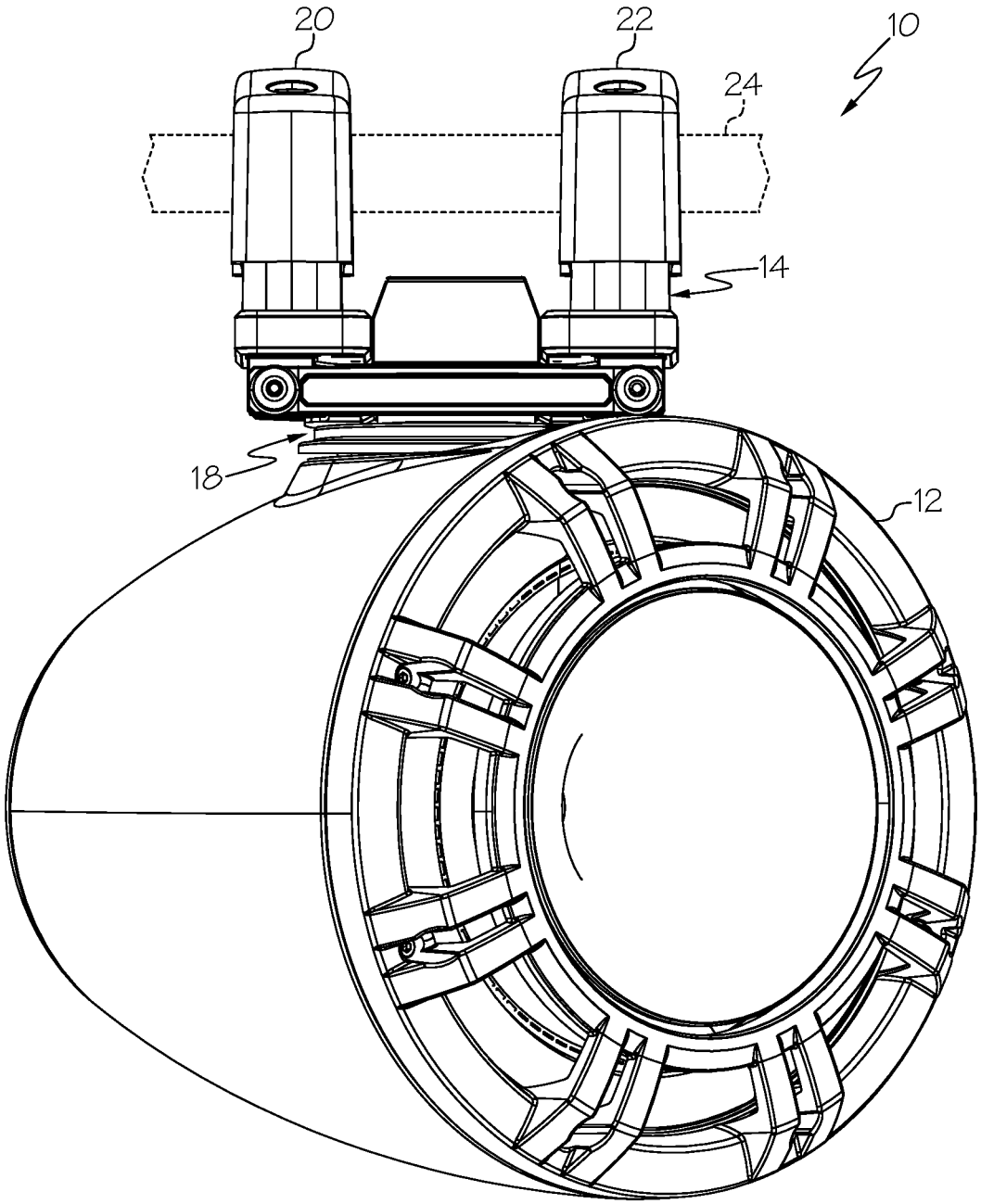
FIG. 2 is a frontal view of the loudspeaker assembly shown in FIG. 1 with the speaker rotated to the right relative to the mounting assembly. The swivel assembly allows the mounted speaker to be rotated to direct sound as desired.
Figure 3:
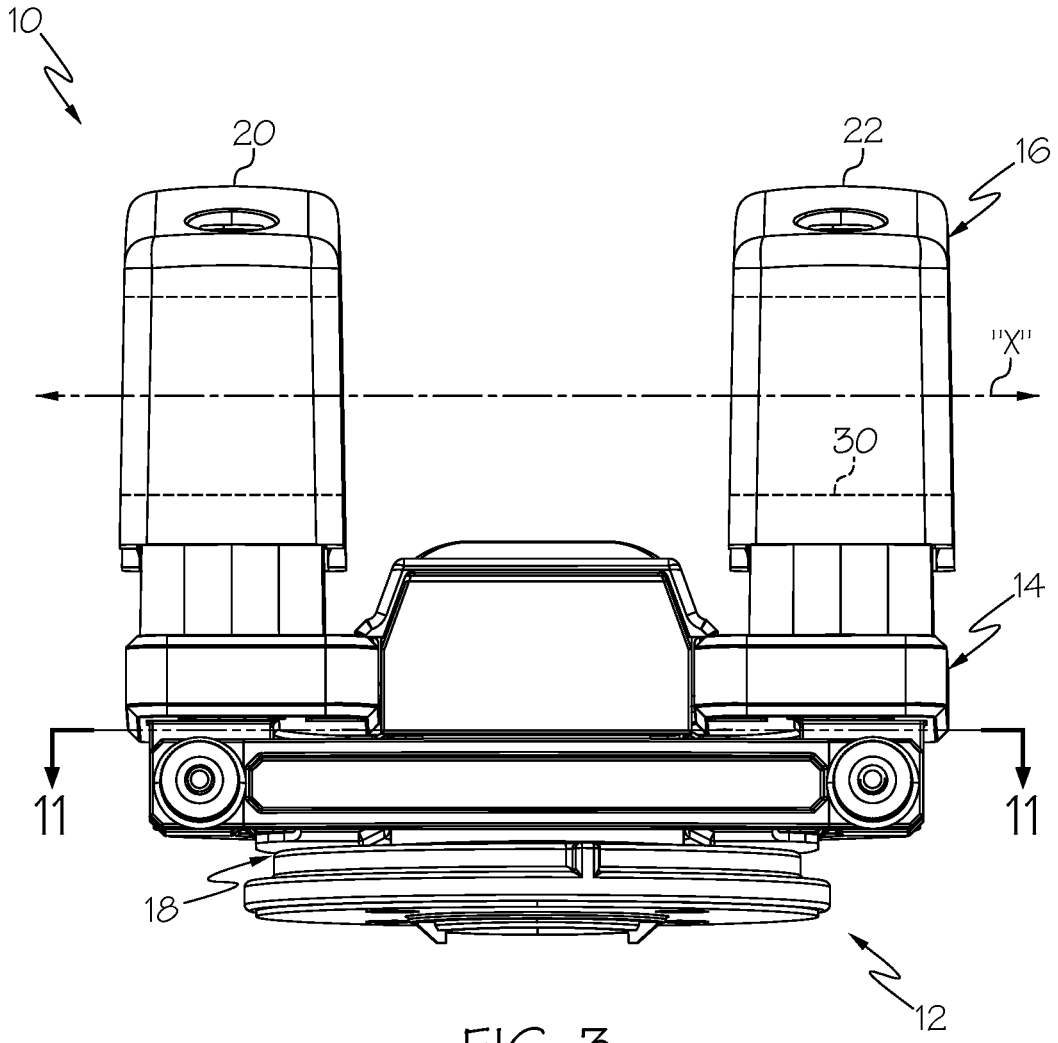
FIG. 3 is an enlarged frontal view of the loudspeaker assembly shown in FIG. 1.
Figure 4:
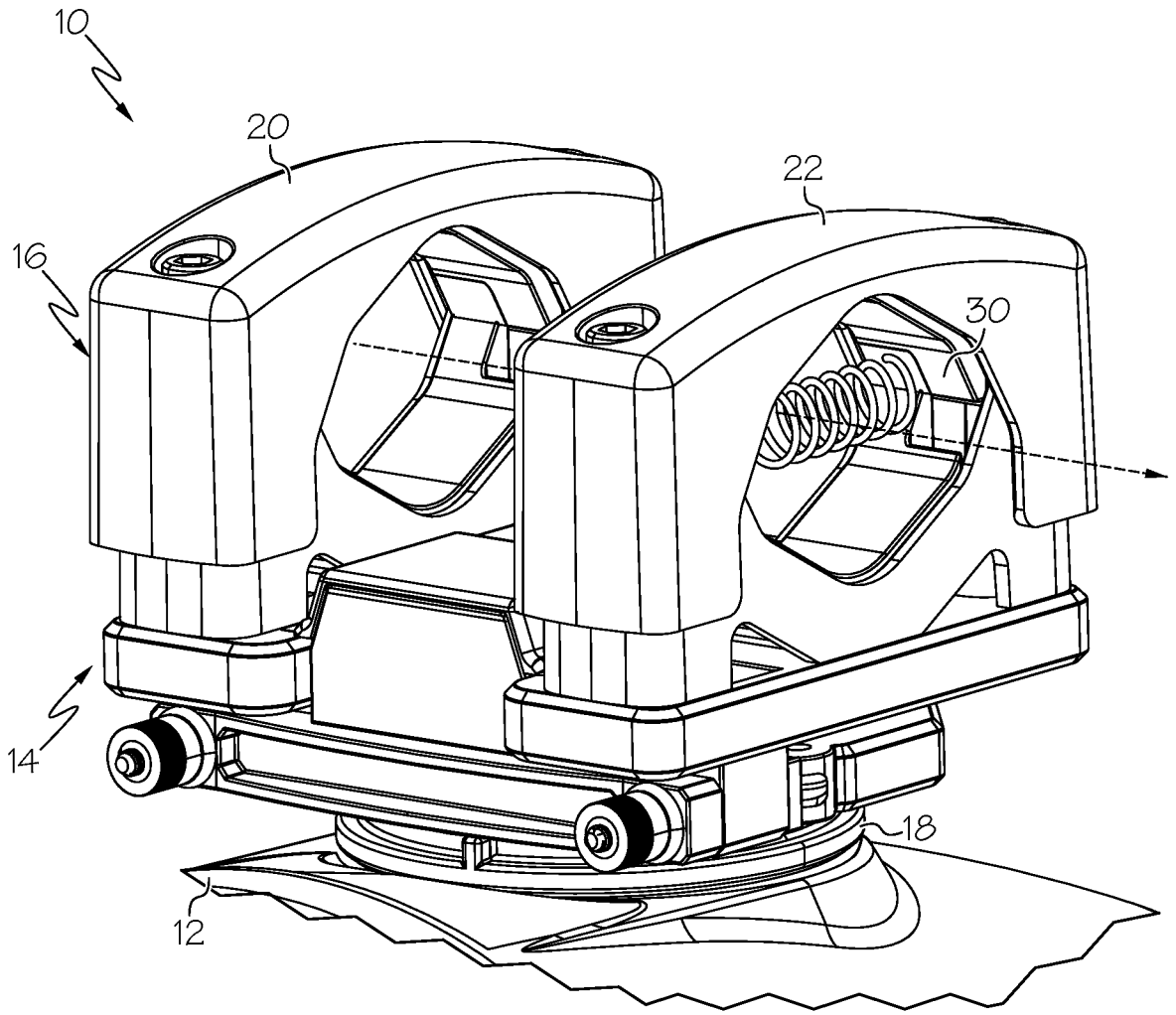
FIG. 4 is a perspective view of the loudspeaker assembly shown in FIG. 1.
Figure 8:
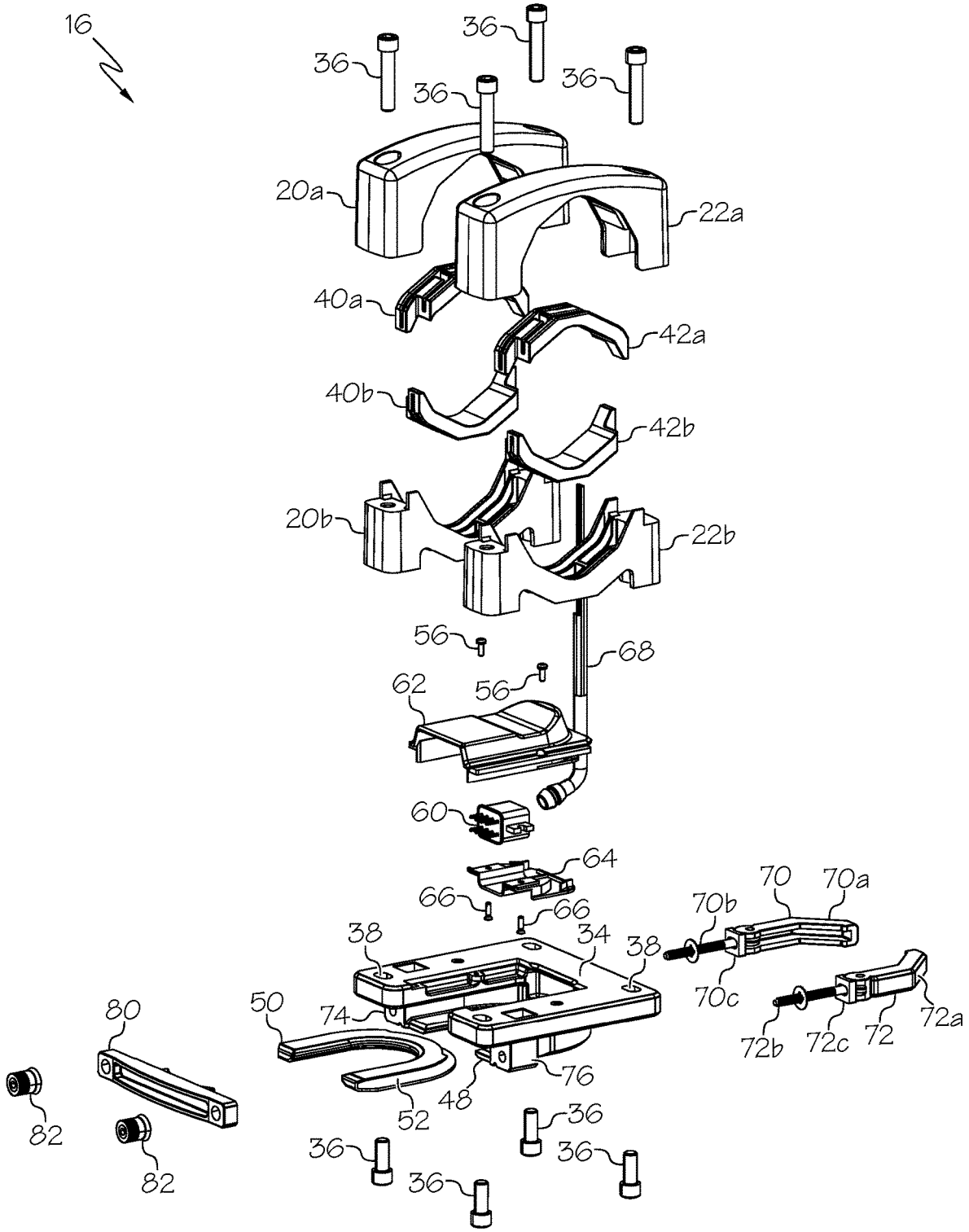
FIG. 8 is an exploded perspective view of the clamp assembly.

As seen in FIGS. 2 and 3, the mounting assembly 14 includes a clamp assembly 16 and a swivel assembly 18. The clamp assembly 16 comprises at least one clamp 20 for attachment to a wakeboard tower or bar or other elongate support 24, which could be vertical or horizontal. In the embodiment illustrated, the clamp assembly comprises a pair of spaced apart clamps, but in some embodiments there is only one clamp or more than two clamps. Each clamp may comprise upper and lower clamp members that are bolted together as best seen in FIG. 8.

One embodiment of the clamp assembly 16 is illustrated in FIGS. 5-8, to which attention now is directed. As indicated, the clamp assembly may comprise first and second clamps 20 and 22. The first and second clamps 20 and 22 may be spaced a distance apart and together may cooperatively define a support receiving channel 30 configured to receive the elongate support 24, such as a wakeboard tower. The support receiving channel 30 may be configured to attach to a cylindrical elongate bar and thus may have an axis "X," as seen best in FIG. 13 discussed below. As used herein, "axis" refers to an imaginary line about which a structure is symmetrical.

Figure 1:
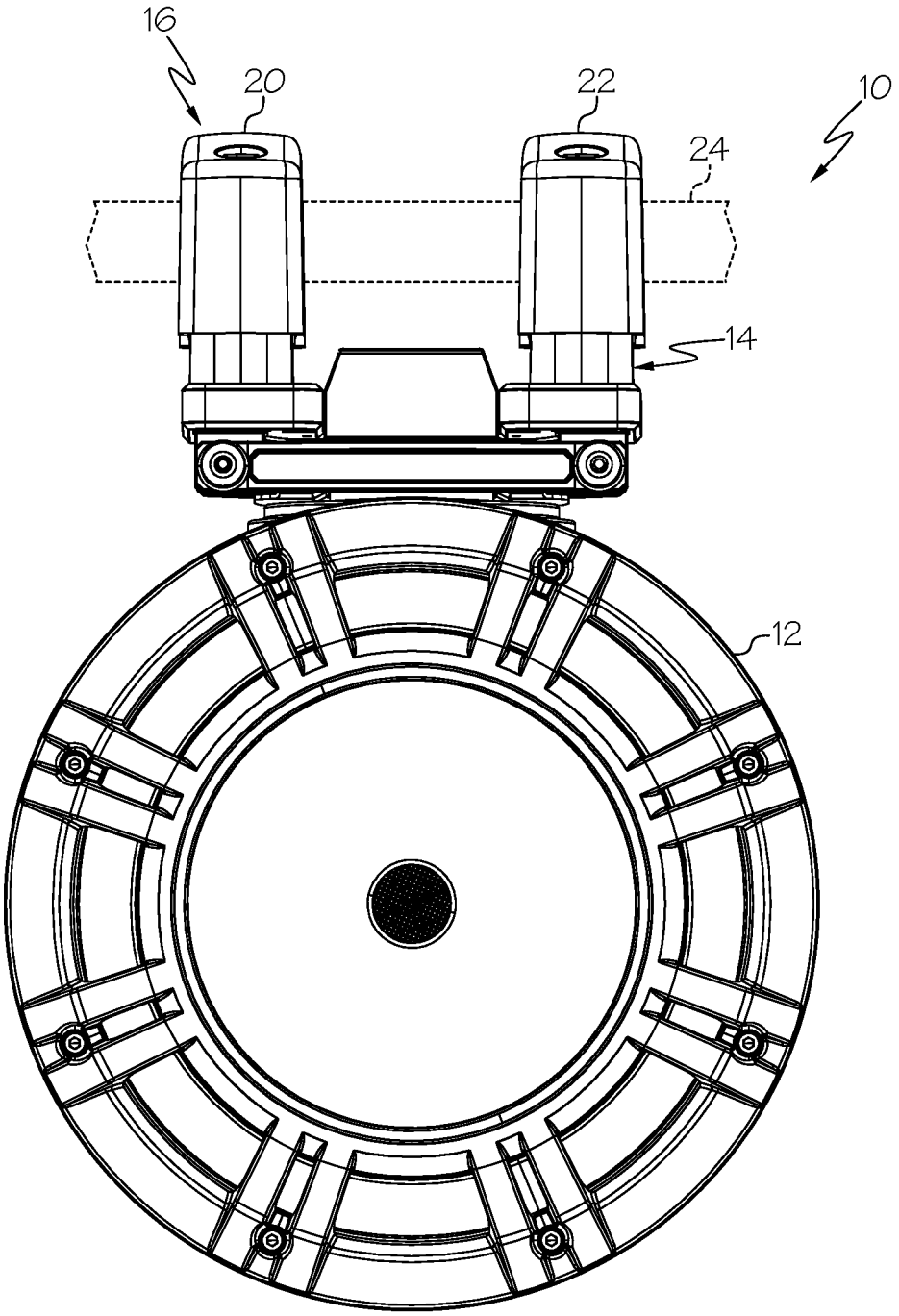
FIG. 1 is a frontal view of a loudspeaker assembly made in accordance with a preferred embodiment of the present invention. The speaker is shown in a straight or non-rotated position relative to the mounting assembly.

In the embodiment shown, the first and second clamps 20 and 22 are supported on a base 34. Although the size and configuration of the base 34 may vary, a generally U-shaped base is advantageous for a reason that will become apparent. As shown in FIGS. 5-8, the clamps 20 and 22 may each comprise upper and lower clamp members 20*a* and 20*b* and 22*a* and 22*b* that together form the support receiving channel 30. The upper and lower clamp members 20*a* and 20*b* and 22*a* and 22*b* may be attached to the base 34 using bolts designated collectively at 36 that are received in bolt holes 38 in the base. The clamps 20 and 22 may also include liners 40*a* and 40*b* and 42*a* and 42*b* to grip the elongate support 24 (FIGS. 1&2). The liners 40*a* and 40*b* and 42*a* and 42*b* may be formed of a resilient composite material, such as rubberized polyvinylchloride (PVC).

Figure 5:
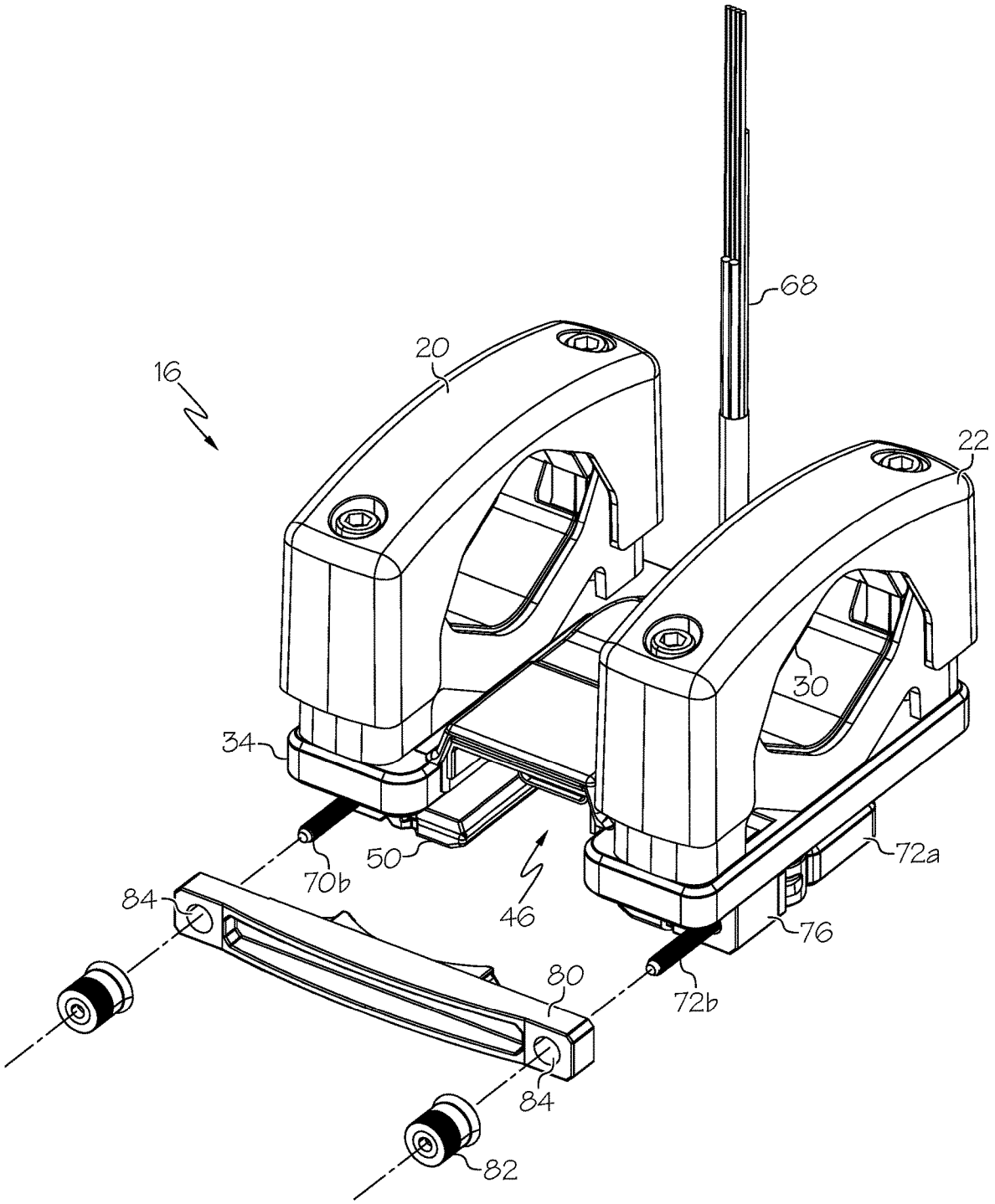
FIG. 5 is a partially exploded frontal perspective view of the clamp assembly.
Figure 6:
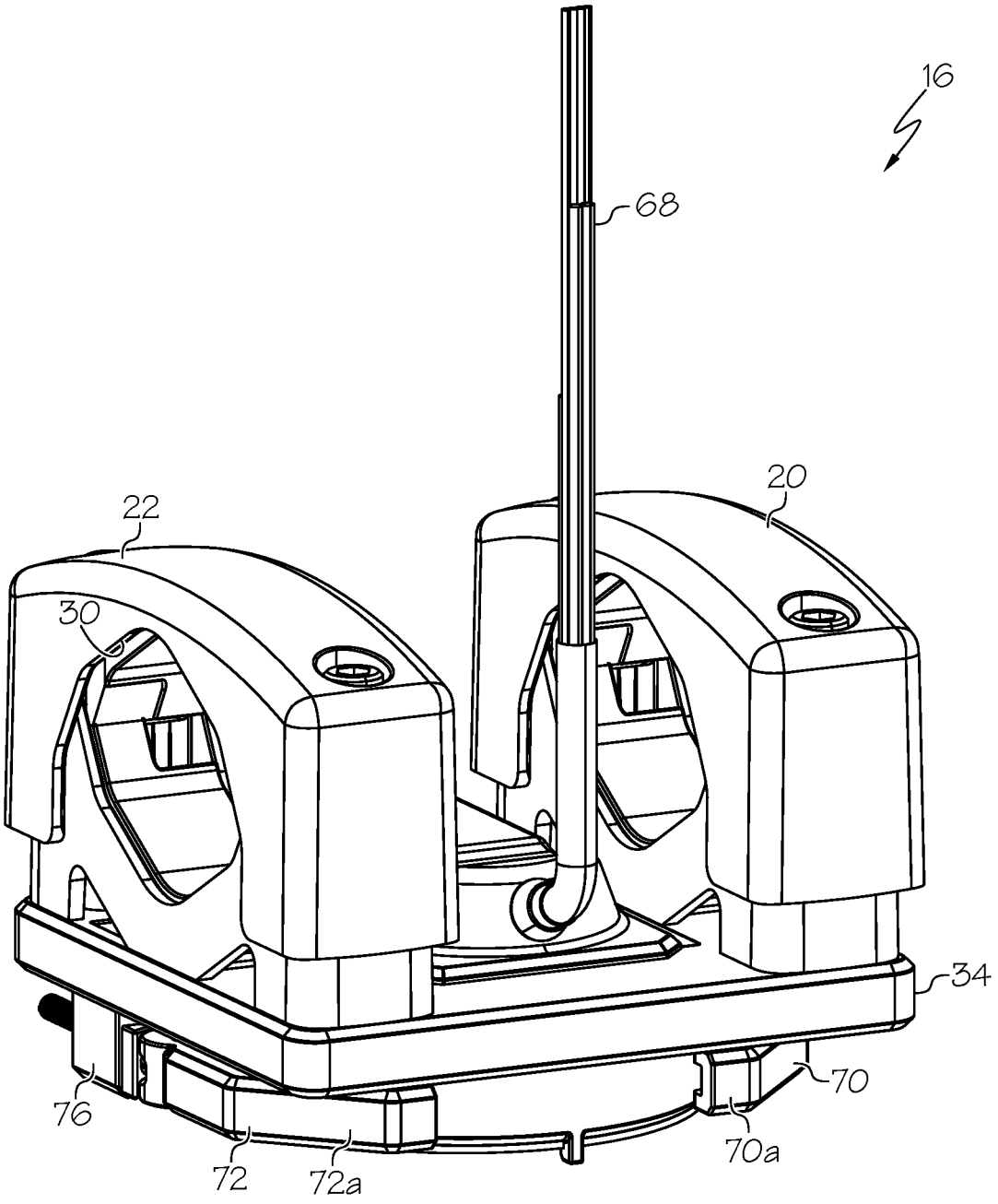
FIG. 6 is a rear perspective view of the clamp assembly shown in FIG. 5.
Figure 7:
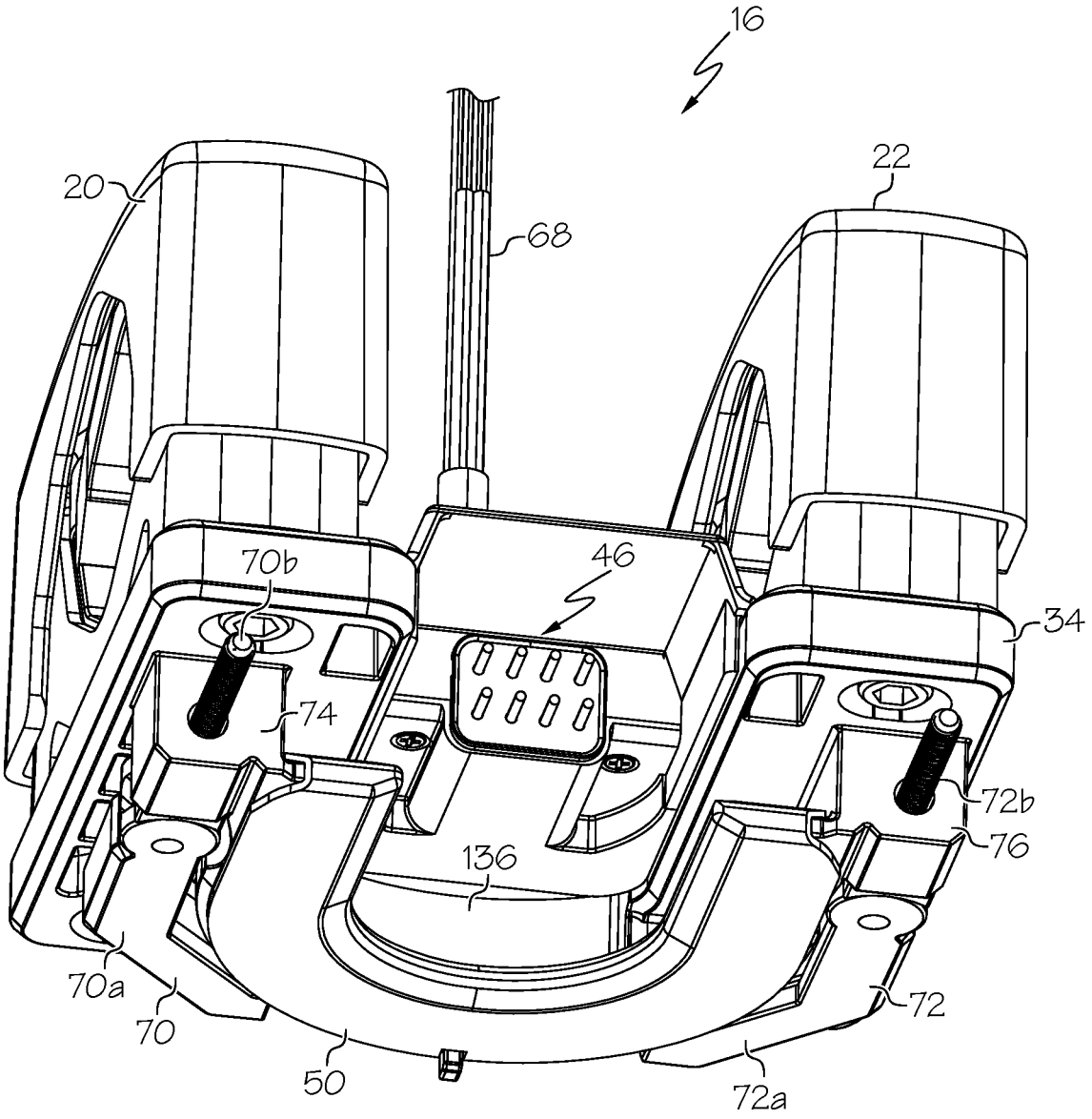
FIG. 7 is a perspective view of the bottom of the clamp assembly shown in FIG. 5.

As best seen in FIGS. 5 and 7, the base 34 may define a docking channel 46. The docking channel 46 has an open front (FIG. 5) and may have a closed rear (FIG. 6). As explained more fully hereafter, the docking channel 46 has an axis "Y," best seen in FIG. 13. In the exemplary embodiment, the axis "Y" of the docking channel 46 is perpendicular to the axis "X" of the support receiving channel 30 (FIG. 5).

The docking channel may have an open bottom defined by a U-shaped shelf 48, which may be equipped within a slide-in U-shaped liner 50. The liner 50 may have a peripheral groove 52 for receiving the inner edge of the shelf 48. The liner may be formed of a resilient composite material, such as rubberized polyvinylchloride (PVC).

As seen best in FIG. 7, a first terminal block 60 may be supported on the base at the closed rear of the docking channel 46. In the preferred practice of the invention, the electrical connections in the mounting assembly are made by pin and socket type connectors. In the embodiment shown, the electrical terminal 60 comprises pin elements to mate with sockets in the swivel assembly yet to be described. Alternately, the first terminal block 60 may comprise the sockets while the swivel assembly includes the pins.

The first terminal block 60 may be contained within a terminal enclosure formed by a top cover 62 and a bottom cover 64, as shown in FIG. 8, attached to each other using screws 66 (FIG. 8). The top and bottom covers 62 and 64 are configured to capture the terminal block 60 inside allowing the wiring bundle 68 to extend out the rear (FIGS. 6&8). The wire bundle 68 may be sheathed and provided with a rubber grommet for the tower bar to further simplify installation.

As explained previously, one particularly advantageous feature of the mounting assembly 14 of the present invention is that the position of the loudspeaker 12 relative to the clamp assembly 16 is adjustable. To secure the installed loudspeaker 12 in the adjusted position, the clamp assembly 16 may include locks. These locks may take any suitable form.

In one embodiment, shown and described herein, the locks take the form of a pair of cam locks 70 and 72. Each cam lock 70 and 72 comprises a cam arm, 70*a* and 72*a*, pivotally attached to one end of a threaded cam rod 70*b*, 72*b*. The cam rods 70*b* and 72*b* are received in cam blocks 74 and 76 supported underneath the base 34 to that the free ends of the rods extend a distance forward of the cam blocks. The cam locks 70 and 72 include cam nuts 70*c* and 72*c*. The operation of the cam locks 70 and 72 in the assembled device will be explained hereafter.

Figure 8A:
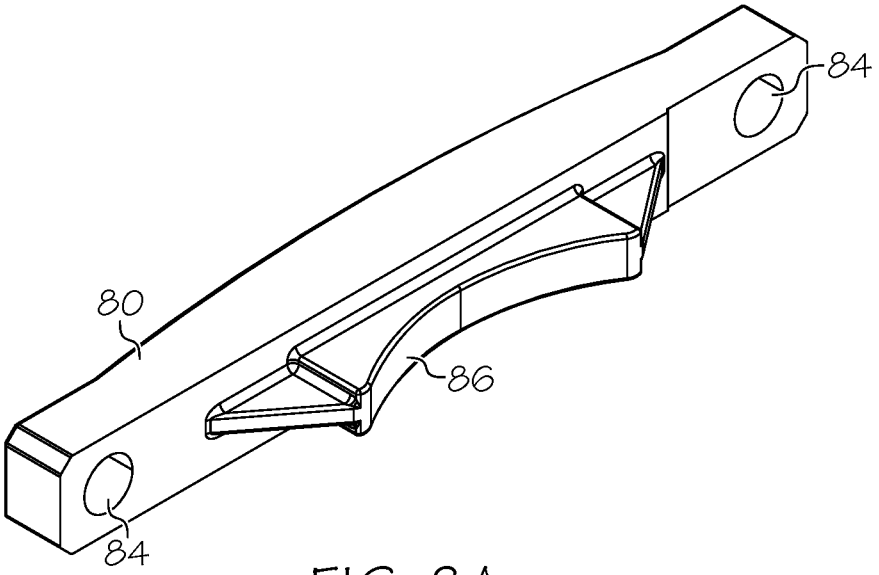
FIG. 8A is a top perspective view of the gate of the clamp assembly.
Figure 8B:
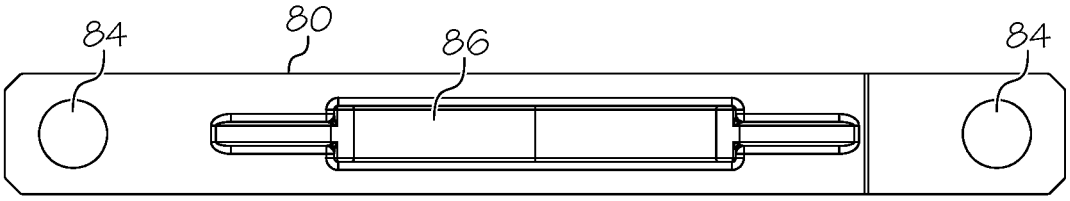
FIG. 8B is an elevational view of the inside (back) of gate.

As will be explained hereafter, the terminal block of the swivel assembly 18 is inserted into the docking channel 46 to make the electrical connections between the loudspeaker 12 and clamp assembly 14. To protect and enclose the mated terminal blocks, the clamp assembly 14 may comprise a gate 80 attachable across the front opening of the docking channel using connectors such as thumb nuts 82, for example. Conveniently, the gate 80 may include holes 84 (FIG. 5) positioned to receive the free ends of the cam rods 70*b* and 72*b*, and the thumb nuts 82 then may be threaded to attach to the free ends of the cam rods. As shown in FIGS. 8A and 8B, the back or inside surface of the gate 80 includes an elongate horizontally extending bumper 86 with an inwardly curved profile for a purpose described below.

Figure 9:
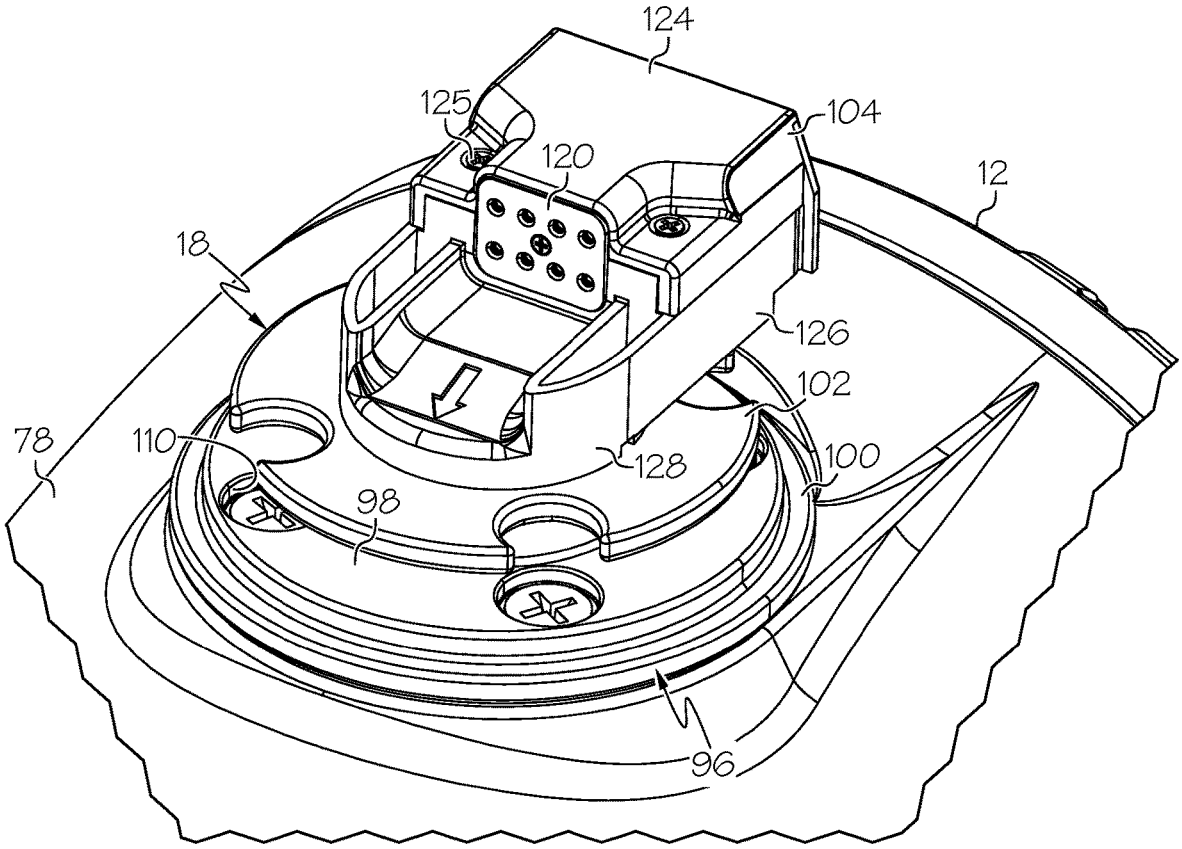
FIG. 9 is a perspective view of the swivel assembly attached to the top of the loudspeaker enclosure.
Figure 10:
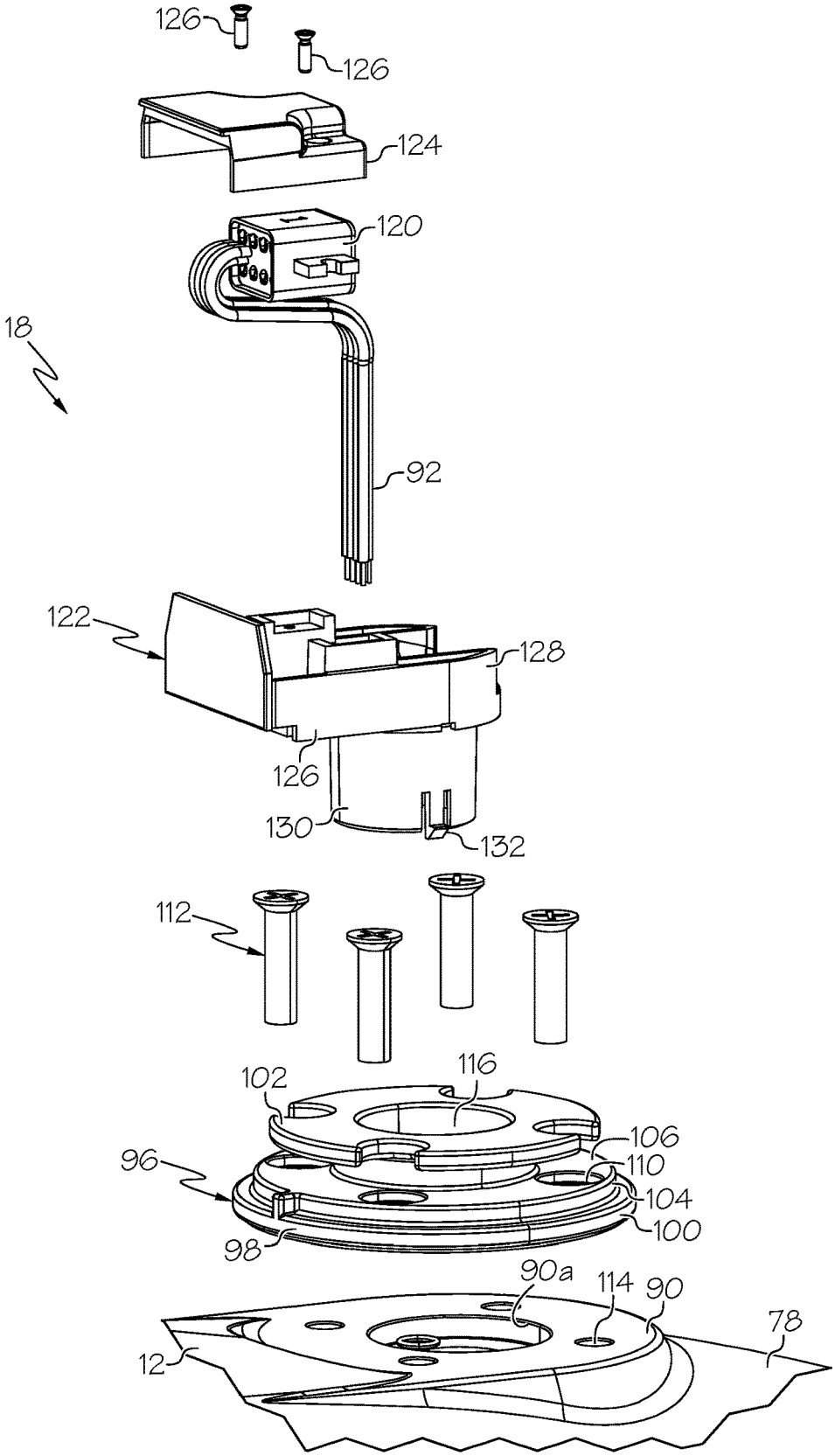
FIG. 10 is an exploded perspective view of the swivel assembly.

With reference now to FIGS. 9 and 10, an embodiment of the swivel assembly 18 will be explained. The housing or enclosure 78 of the loudspeaker 12 may include a bracket face 90 (FIG. 10), which may be formed integrally into the enclosure or formed separately and attached to the enclosure. The bracket face 90 includes a central opening 90*a* to receiving the wiring bundle 92.

The swivel assembly 18 includes a mounting bracket 96. The mounting bracket 96 comprises a bottom plate 98 with a bottom face that mates with the bracket face 90 on the enclosure 78. The upper surface of the bottom plate 98 defines a circumferential shoulder 100. A flange 102 is supported on a narrow diameter section 104 of the bracket 96 forming a circumferential groove 106. Bolt holes, designated collectively at 110, extending through the flange 102 and the bottom plate 96 receive bracket bolts 112, collectively, are aligned with holes 114 (FIG. 10) in the bracket face 90 on the enclosure 78 for attaching the mounting bracket 96 to the enclosure 78. A central opening 116 (FIG. 10) extends through the mounting bracket 96 to accommodate the wiring bundle 92.

Referring still to FIGS. 9 and 10, the swivel assembly 18 includes a second terminal block 120 with sockets for receiving the pins in the first terminal block 60 in the clamp assembly 16. As indicated, these components could be reversed, so that the pin connector is in the swivel assembly 18 and the socket connector is in the clamp assembly 16.

The terminal block 120 (sockets) is supported inside a swivel housing 122 with a cover 124 attachable with screws 125. The swivel housing 122 includes docking body 126 with a downwardly extending sleeve 130 that is received in the central opening 116 in the bracket 96. A resilient catch or detent, such as one or more flexible hooks 132 is provided on the sleeve 130. This allows the swivel housing 122 to be snapped into place allowing rotational movement of the swivel housing but preventing withdrawal of the housing from the bracket 96.

The swivel housing 122 is configured to be received in the docking channel 46 (FIG. 5) of the clamp assembly 16. More specifically, the docking body 126 is shaped to slide into the docking channel 46 horizontally (as viewed in the drawings) so that flange 102 slides in over the shelf 48 and liner 50 and so that the terminal block 120 (sockets) mates with the terminal block 60 (pins) in the clamp assembly 16. It is advantageous to provide the leading portion of the docking body 126 with a curved front section 128 (FIG. 9) as this will facilitate the entry of the docking body into the docking channel 46. The curved front 128 will self-align the docking body 126 if the body is not perfectly aligned with the channel 46 as the docking body is inserted.

Figure 11:
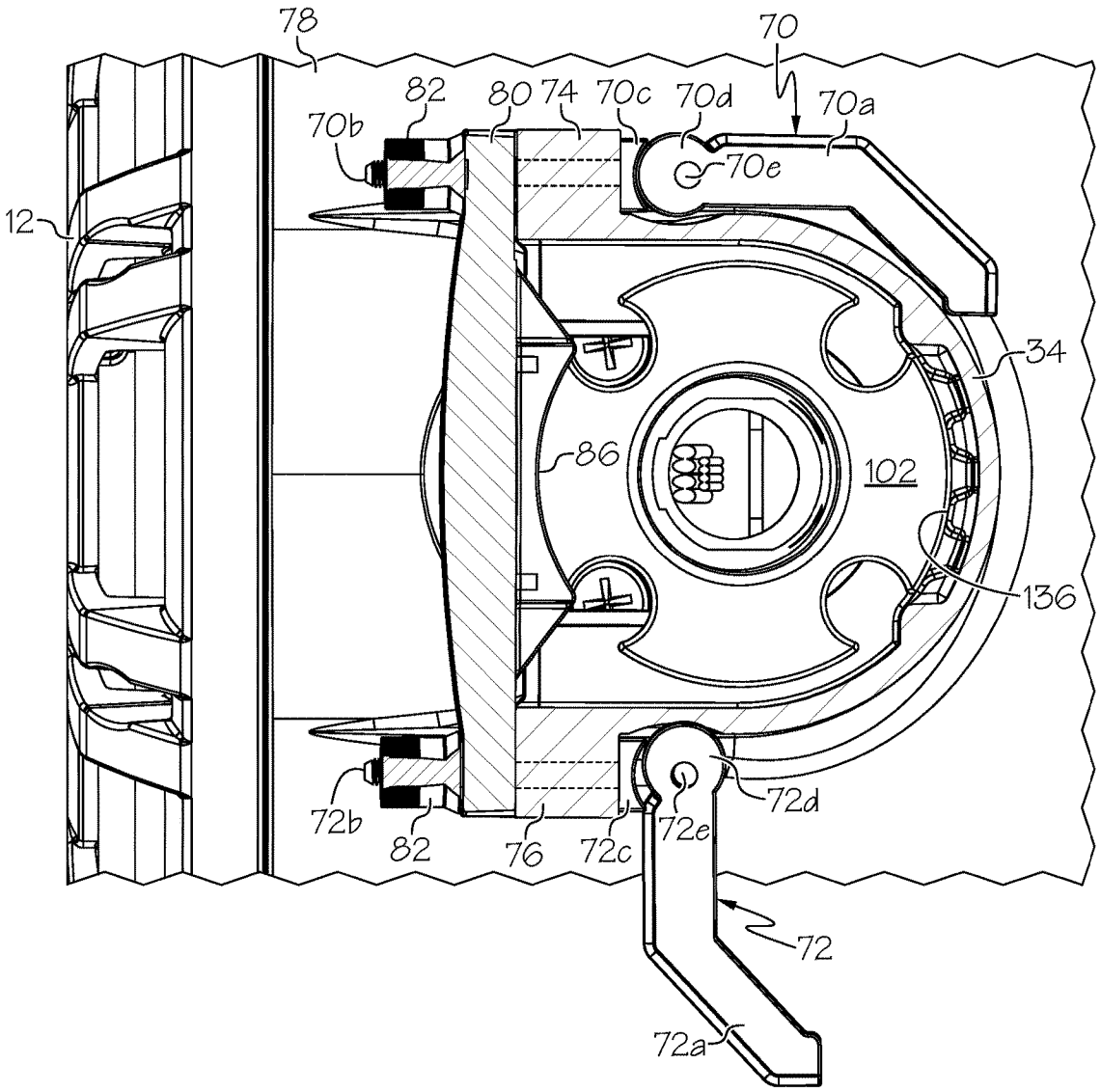
FIG. 11 is an enlarged, fragmented sectional view of the loudspeaker assembly taken along line 11-11 in FIG. 3 and illustrating the operation of the cam locks.

Having described how the swivel assembly 18 is engaged with the clamp assembly 16, the operation of the cam locks 70 and 72 will be explained more fully. As shown in FIG. 11, the cam locks 70 and 72 are mounted under the base 34. The gate 80 is supported on the cam rods 70*b* and 72*b*. As shown, the heads 70*d* and 72*d* are rounded and are mounted on pins 70*e* and 72*e* for rotational movement. The rounded heads 70*d* and 72*d* are received in a concave surface on the cam nuts 70*c* and 72*c*.

The pins 70*e* and 72*e* are off center so that, in the closed position with the cam arm 70*a* and 72*a* hugging the side of the base 34, the heads 70*d* and 72*d* closely abut the convex surfaces of the cam nuts 70*c* and 72*c*. This snugs up the abutting surfaces of the thumb nuts 82, the gate 80, the cam blocks 74 and 76, the cam nuts 70*c* and 72*c*, and the heads 70*d* and 72*d* of the cam arms 70*a* and 72*a*. In addition, in this position, the convex front edge of the flange 102 abuts the concave surface of the bumper 86 on the inside of the gate 80, and the rear edge of the flange abuts the rounded rear wall 136 (see also FIG. 7) of the docking channel 46. This frictionally secures the flange 102 and thus prevents rotation of the swivel assembly 18.

To adjust the orientation of the loudspeaker 12, the cam arms 70*a* and 72*a* are moved to the open position (at bottom of FIG. 11). In this open or "loose" position, there is a small space between the sides of the heads 70*d* and 72*d* and the concave surfaces of the cam nuts 70*c* and 72*c*. This space releases the grip on the flange 102 and allows rotation of the swivel assembly 18. When the desired orientation of the loudspeaker 12 is achieved, the cam arms 70*a* and 70*b* are returned to the closed position (above in FIG. 11), in which the cam arms are tucked under the base 34 again griping the flange 102 of the swivel assembly 18 to prevent dislocation.

Use of the mounting assembly 14 will now be explained with reference to FIGS. 12-17. In most instances, the mounting assembly 14 will be attached to a loudspeaker, such as the bullet-shaped speaker 12 shown in the drawings, providing the loudspeaker assembly 10. If this is not the case, the attachment plate 90 should be bolted to the enclosure 78 of the loudspeaker 12.

Figure 12:
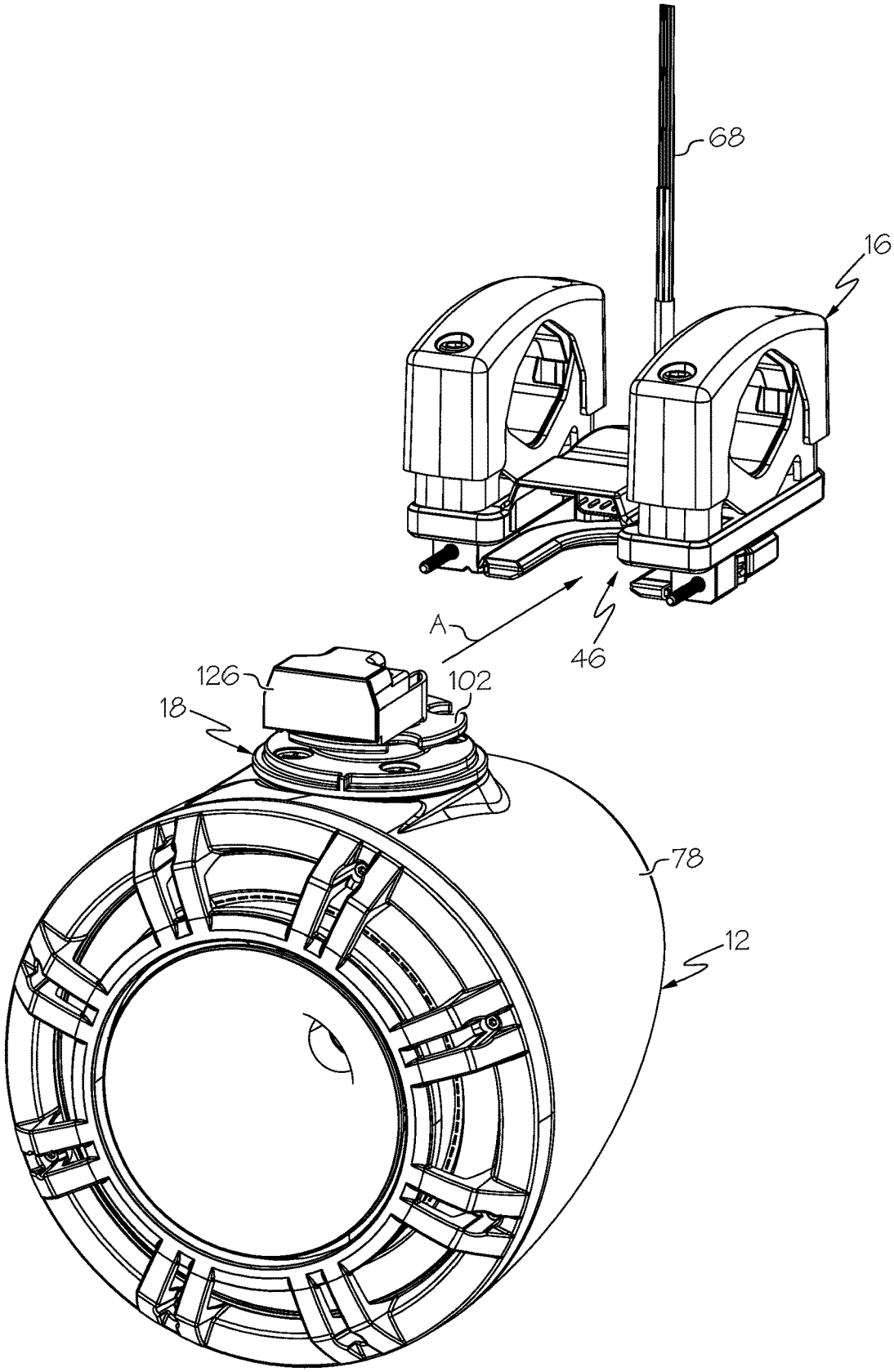
FIG. 12 shows the first step in installing the loudspeaker and mounting assembly. The loudspeaker is positioned in front of the clamp assembly with the terminal block of the swivel assembly generally aligned with the docking channel in the clamp assembly.
Figure 14:
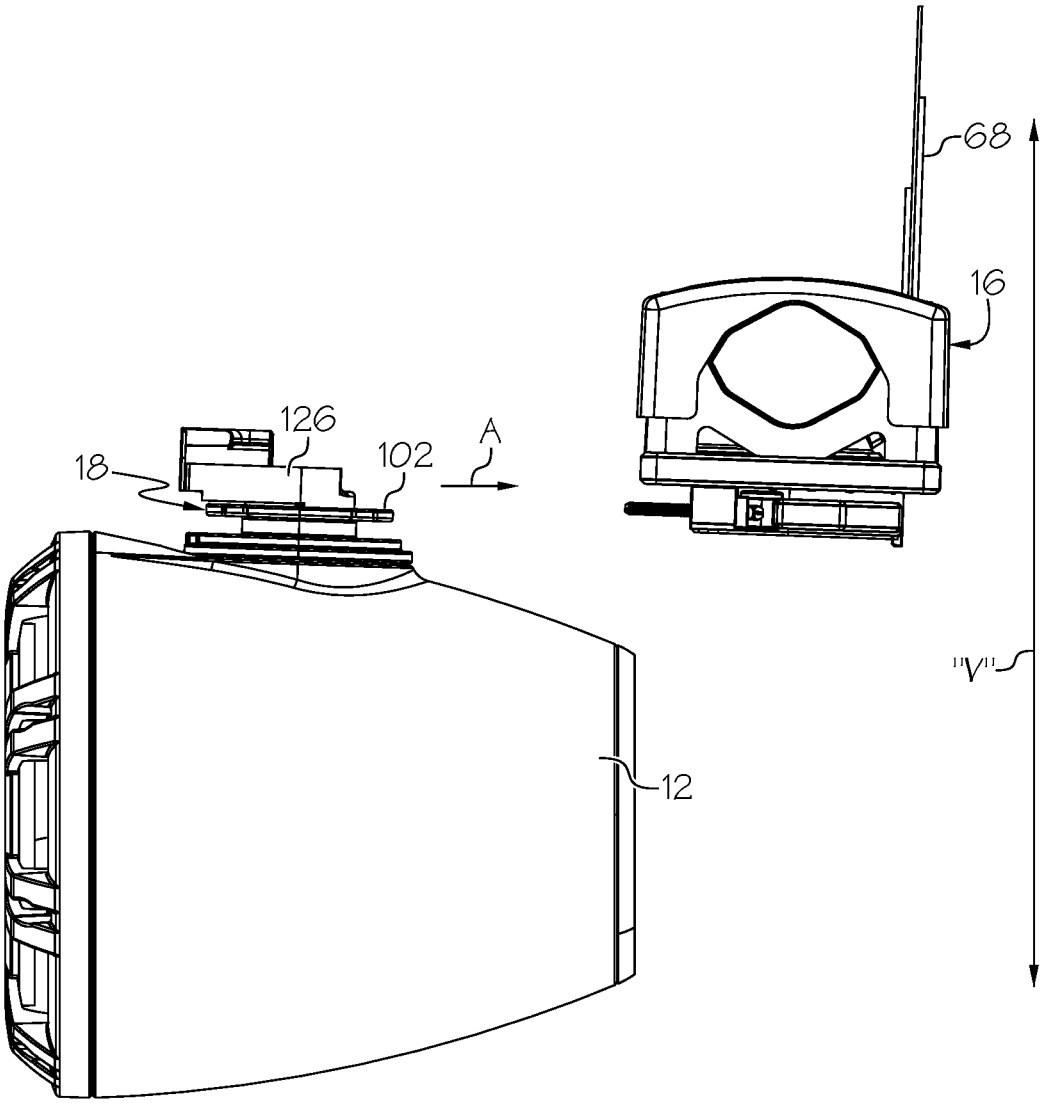
FIG. 14 is a side view of the loudspeaker and clamp assembly shown in FIG. 12.

Next, the clamp assembly 16 is mounted on the tower bar (FIGS. 1&2) or other support 24. The wire bundle 68 (audio, LED, ground, etc.) is threaded through the bar 24 and connected to their respective sources. The wiring connections are now complete. The gate 80 and thumb nuts 82 are removed from the base providing access to the docking channel 46, and the cam locks 70 and 72 are moved to their open (unlocked) positions. In most instances, the support 24 will be horizontal, that is, perpendicular to the normal gravity vector "V" (FIG. 14). As used herein, "normal gravity vector" means a vector that is perpendicular to the surface of the earth. Thus, as best shown in FIG. 12, the now open docking channel 46 is horizontally aligned, that is, perpendicular to the normal gravity vector "V."

With the docking channel 46 open and accessible, the installer holds the speaker 12 in front of and slightly below (FIGS. 13&14) the clamp assembly 16 aiming the docking body 126 of the swivel assembly 18 toward the open front of the docking channel 46. The docking body 126 is moved in the direction of the arrow "A" into the docking channel 46. Recall that the curved front 128 (FIG. 13) of the docking body 126 will self-align as it is guided into the channel 46. If the center front of the docking body 126 is pointing within about 120° of the center of the docking channel 46, it will self-align as it is being inserted. This simplifies installation; if the docking body 126 is just "in the ball park," it self-rotates into the channel with the first and second terminal blocks 60 (FIG. 7) and 120 (FIG. 9) aligned for proper connection.

Figure 15:
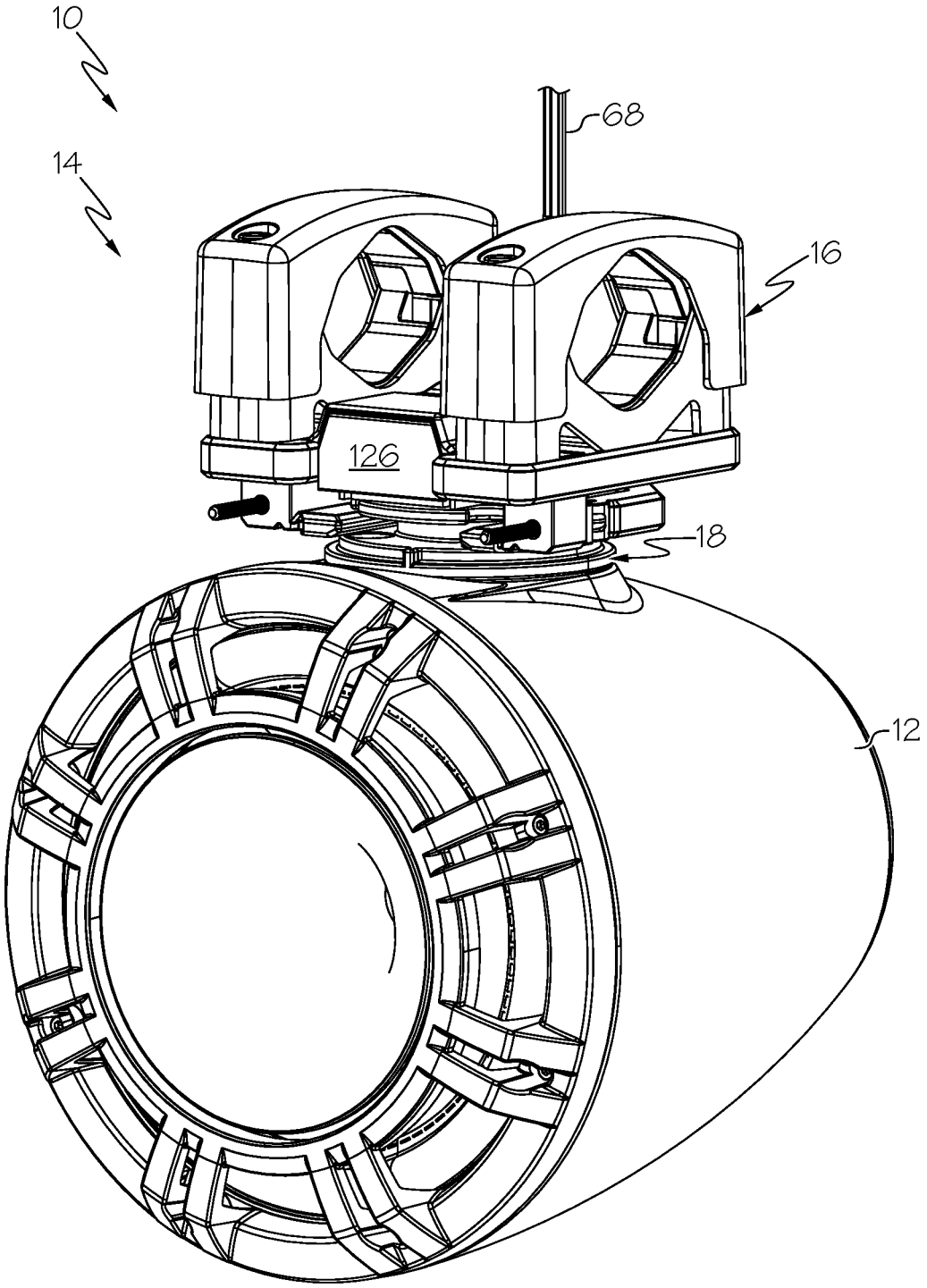
FIG. 15 is a perspective view showing the terminal block of the swivel assembly docked in the docking channel of the clamp assembly.

The side edges of the flange 102 are positioned over the liner 50 and shelf 48 so that the liner and shelf slide into the groove 106 (FIG. 10) and until the second terminal block 120 engages the first terminal block 60. This establishes the electrical connection between the speaker 12 and the wiring bundle 58. Additionally, as illustrated in FIG. 15, the speaker 12 now is supported by gravity eliminating the need for the installer to continue to support the speaker with one hand while struggling to complete other wiring or hardware connections with the other hand. This "hands free" gravity-supported feature is particularly advantageous as it frees up both hands of the installer to adjust the speaker position.

Figure 16:
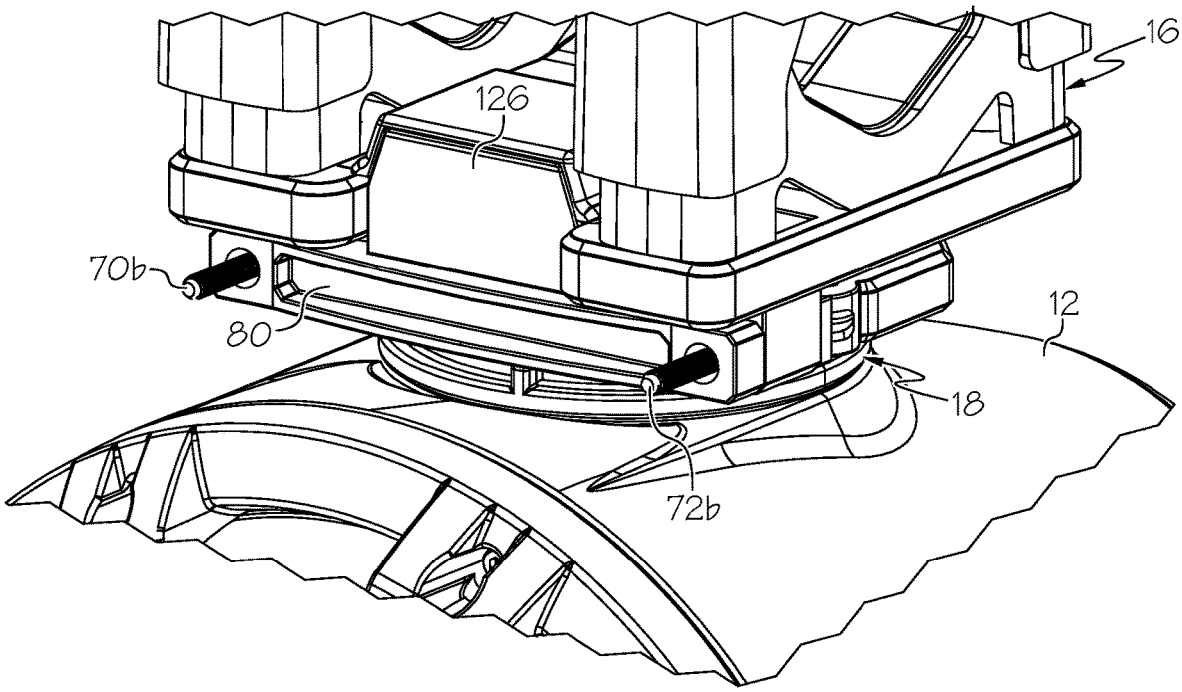
FIG. 16 is an enlarged view showing the gate in position across the front opening into the docking channel.
Figure 17:
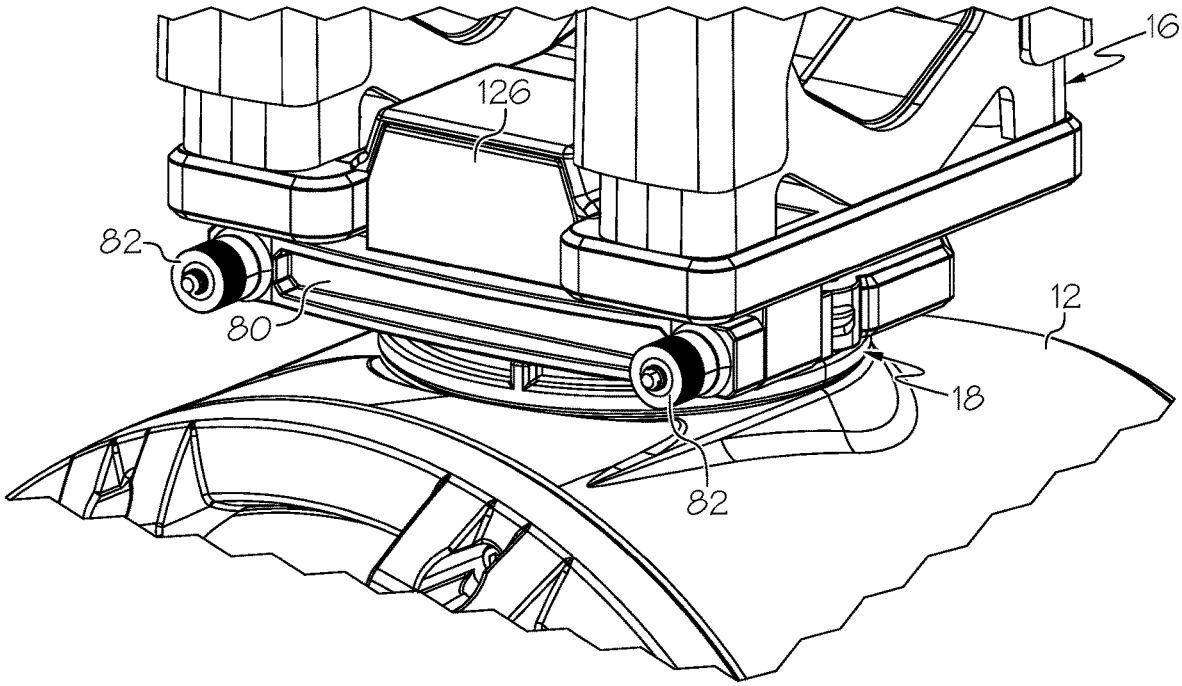
FIG. 17 is an enlarged view showing the thumb nuts attached to secure the gate in position completing the installation.

Once the docking body 126 is positioned in the docking channel 46, the gate 80 then is placed on the cam rods 70*b* and 72*b*, as seen in FIG. 16. Then, the thumb nuts 82 are attached to secure the gate 80 in position, as seen in FIG. 17.

Figure 13:
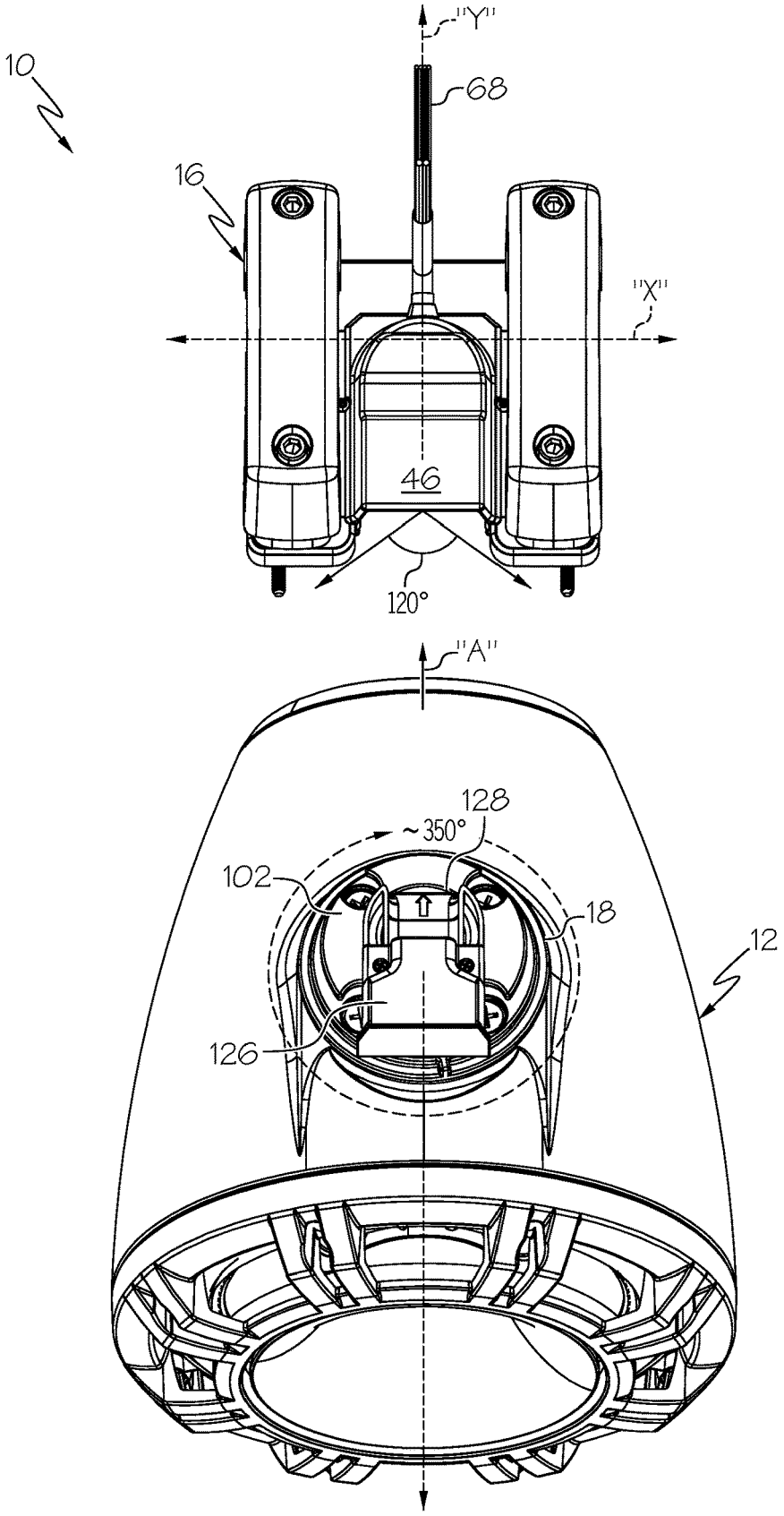
FIG. 13 is a plan view of the loudspeaker and clamp assembly shown in FIG. 12.

As explained previously, the orientation or direction of the speaker can be adjusted without removing the gate 80 or the thumb screws 82. Rather, moving the cam locks 70 and 72 to the outspread or open position will allow rotation of the speaker 12 to the desired position. Notably, the embodiment shown and described herein permits the installed speaker 12 to be rotated at least more than 180 degrees, preferably more than 270 degrees and most preferably up to at least about 350 degrees, as illustrated in FIG. 13. Still further, in other embodiments of the invention, a rotary type electrical connection may be employed instead of the pin and socket type connector shown, which would allow greater rotational range. As used herein, "rotation," "rotatable," "rotatably," are not to be construed as limited by a minimum or maximum range of rotation.

While the present invention is illustrated as supporting a speaker from a horizontal support, it is not so limited. The clamp assembly could be attached to a vertical support or to any elongate support at an angle to the vertical (normal gravity vector).

The embodiments shown and described above are exemplary. Unless otherwise stated explicitly, each element shown or described herein is optional. Many details are often found in the art and, therefore, many such details are neither shown nor described herein. It is not claimed that all of the details, parts, elements, or steps described and shown were invented herein. Even though numerous characteristics and advantages of the present invention have been described in the drawings and accompanying text, the description is illustrative only.

Changes may be made in the details, especially in matters of shape, size, and arrangement of the parts within the principles of the invention to the full extent indicated by the broad meaning of the terms of the attached claims. Unless otherwise expressly stated, each and every element described and shown herein is optional.

The description and drawings of the specific embodiments herein do not point out what an infringement of this patent would be, but rather provide an example of how to use and make the invention. Likewise, the abstract is neither intended to define the invention, which is measured by the claims, nor is it intended to be limiting as to the scope of the invention in any way. Rather, the limits of the invention and the bounds of the patent protection are measured by and defined in the following claims.

What is claimed is:

1. A mounting assembly for attaching a loudspeaker to an elongate support, the mounting assembly comprising:

a clamp assembly comprising:

a base defining a docking channel having an axis;

at least one clamp supported on the base and defining a support receiving channel configured to receive the elongate support, the support receiving channel having an axis that is perpendicular to the axis of the docking channel; and a first terminal block supported in the docking channel;

a swivel assembly comprising:

a mounting bracket attachable to the loudspeaker;

a docking body rotatably supported on the mounting bracket;

a second terminal block in the docking body;

wherein one of the first and second terminal blocks comprises a plurality of electrical pins and wherein the other of the first and second terminal blocks comprises a plurality of electrical sockets;

wherein the docking body of the of the swivel assembly is sized to be slidably received in the docking channel;

wherein, when the docking body is positioned in the docking channel, the mounting bracket is rotatable relative to the clamp assembly without concurrent rotational movement of the docking body; and wherein the first and second terminal blocks are cooperatively configured so that, when the docking body is received in the docking channel, the electrical pins are electrically engaged with the electrical sockets.

2. The loudspeaker mounting assembly of claim 1 wherein, when the docking body is received in the docking channel, the docking body is supported by gravity.

3. The speaker mounting assembly of claim 1 wherein the at least one clamp assembly comprises a first clamp and a second clamp.

4. The loudspeaker mounting assembly of claim 3 wherein the first clamp and the second clamp are spaced a distance apart and wherein the docking channel is positioned between the first and second clamps.

5. The loudspeaker mounting assembly of claim 1 wherein the base comprises a U-shaped shelf at least partially defining the docking channel, where the mounting bracket of the swivel assembly comprises a flange underneath the docking body, and wherein the flange is configured to at least partially overlap the shelf.

6. The loudspeaker mounting assembly of claim 5 wherein the docking body is rotatable relative to the flange.

7. The loudspeaker mounting assembly of claim 6 wherein the mounting bracket of the swivel assembly comprises an attachment plate beneath the flange for attaching the swivel assembly to the loudspeaker enclosure.

8. The loudspeaker mounting assembly of claim 7 wherein the clamp assembly includes a gate removably attachable to the base when the docking body is received in the docking channel to retain the docking body inside the docking channel.

9. The loudspeaker mounting assembly of claim 7 wherein the clamp assembly further comprises at least one lock for releasably securing the flange of the mounting bracket against rotation.

10. A loudspeaker assembly comprising a loudspeaker and the mounting assembly of claim 1.

11. The loudspeaker assembly of claim 10 when the loudspeaker comprises a bullet shaped enclosure.

12. A mounting assembly for attaching a loudspeaker to an elongate support, the mounting assembly comprising:

a clamp assembly comprising:

a base defining a docking channel having an axis and an upwardly facing longitudinal support surface;

at least one clamp supported on the base and configured to attach to the elongate support; and a first terminal block supported in the docking channel;

a mounting bracket comprising:

an attachment plate attachable to the loudspeaker;

a flange supported on the attachment plate and having a downwardly facing longitudinal support surface configured to be on the upwardly facing longitudinal support surface of the base;

a docking body supported on the flange; and a second terminal block in the docking body;

wherein the attachment plate is rotatable relative to the at least one clamp;

wherein one of the first and second terminal blocks comprises a plurality of electrical pins and wherein the other of the first and second terminal blocks comprises a plurality of electrical sockets;

wherein the first and second terminal blocks are cooperatively configured so that, when the docking body is received in the docking channel, the electrical pins are electrically engaged with the electrical sockets.

* * * * *